US008376725B2

(12) United States Patent
Raubacher

(10) Patent No.: US 8,376,725 B2
(45) Date of Patent: Feb. 19, 2013

(54) PLANETARY ROTATION MACHINE

(76) Inventor: Heinz Raubacher, Vaihingen (DE)

( * ) Notice: Subject to any disclaimer, the term of this patent is extended or adjusted under 35 U.S.C. 154(b) by 643 days.

(21) Appl. No.: 12/448,717

(22) PCT Filed: Dec. 21, 2007

(86) PCT No.: PCT/EP2007/011306

§ 371 (c)(1),
(2), (4) Date: Jul. 2, 2009

(87) PCT Pub. No.: WO2008/080574

PCT Pub. Date: Jul. 10, 2008

(65) Prior Publication Data

US 2010/0071545 A1 Mar. 25, 2010

(30) Foreign Application Priority Data

Jan. 2, 2007 (DE) ..... 10 2007 001 021

(51) Int. Cl.
*F01C 21/00* (2006.01)
*F03C 2/00* (2006.01)
*F03C 4/00* (2006.01)

(52) U.S. Cl. ..... 418/223; 418/225

(58) Field of Classification Search ..... 418/223, 418/225, 226
See application file for complete search history.

(56) References Cited

U.S. PATENT DOCUMENTS 4,636,157 A 1/1987 Van der Werff

FOREIGN PATENT DOCUMENTS

| | | | |
|---|---|---|---|
| DE | 276 122 | A1 | 10/1988 |
| DE | 39 00 375 | A1 | 7/1989 |
| DE | 91 03 452.3 | | 10/1991 |
| FR | 2 500 075 | | 2/1981 |
| GB | 1 283 907 | | 10/1970 |
| GB | 2 262 965 | A | 7/1993 |
| WO | WO 92/16728 | | 10/1992 |

*Primary Examiner* — Theresa Trieu
(74) *Attorney, Agent, or Firm* — Pauley Petersen & Erickson

(57) ABSTRACT

A planetary rotation machine including at least one ring channel which is curved along an at least partial arc and that contains a piston that can be moved in a fluid generating a movement. The piston can be coupled to a rotary body coaxially arranged by a lever by the rotational axis thereof. A stable structure able to transmit high torques is obtained by guiding the lever through a gap created in the wall of the ring channel in a direction of displacement of the piston, in a radial direction away from the piston in a sealed manner.

36 Claims, 6 Drawing Sheets

PLANETARY ROTATION MACHINE

BACKGROUND OF THE INVENTION

1. Field of the Invention

This invention relates to a rotary piston machine having at least one annular conduit which is curved along an at least partial arc and in which a piston is movably supported in a movement-imparting fluid that flows in via a fluid connection and flows out via another fluid connection. The piston is coupled via a lever to a rotating body arranged concentric to the arc and coaxial to the rotation axis of the piston, with the lever routed so that it passes through to the rotating body through a sealed gap, which is in the wall of the annular conduit and extends in the movement direction of the piston.

2. Discussion of Related Art

A rotary piston machine of this kind is disclosed in German Patent Reference DE 91 03 452 U1. In this known rotary piston machine in the form of an oil pressure motor, a piston connected to a drive unit is set into rotation in an annular housing through the exertion of oil pressure. Thus, an oil pressure pump supplies oil to the interior of the housing via an oil pressure line to produce an advancing motion of the piston. To avoid oil-damming energy losses that can arise due to a damming-up of oil between a piston wall and a wall of a sliding element, an interposed suction pump removes oil from this region via a suction line, which should assure a continuously uniform revolution of the piston. The piston is attached to a rotatable piston disk, which is routed so that it passes out of the tubular housing radially through a gap and is attached to a central motor shaft. As the cross section in FIG. 2 of this prior publication shows, the two motor halves encompassing the tubular ring chamber extend over the entire cross-sectional area of the motor, with the shaft passing through at a position between the motor halves. In the embodiment shown, the oil pressure inside the cylinder, after flowing into the cylinder chamber, can spread out uniformly in both directions, with the suction line clearly ending in an oil sump. This design does not achieve a sustained operating function. Also, no information is given regarding a seal, which is essential for the function.

German Patent Reference DD 276 122 A1 discloses a hydraulic motor with a transmitting function, in which certain rotation angle adjustments are possible at low motor speeds. In this instance, flat pistons situated in a segment sleeve affixed to a housing are radially arranged in a sliding fashion around a gear on a shaft that is rotatably supported in the housing. The pistons have a wedge-shaped tip oriented toward the gear and a T-shaped embodiment at the end oriented away from the gear. Oil pushing into a cylinder chamber slides the flat pistons with the wedge-shaped tips into the teeth of the gear. The division difference between the flat pistons and the gear causes the gear to rotate, as a result of which there are always several pistons in operation. The continuous sequential impingement on the flat pistons produces a uniform rotating motion. With this embodiment of the hydraulic motor, it is necessary for a plurality of flat pistons to be moved in a coordinated fashion with one another, with their movement occurring in the radial direction. This design, which provides definite rotation angle adjustments, is relatively complex and is only suitable for relatively slow rotational movements.

French Patent Reference FR 2 500 075 A1 discloses another hydraulic motor having a circular cylinder curved in an arc shape and pistons situated therein that are acted on by the hydraulic medium and attached to a central shaft. Inside the cylinder chamber, there are movably supported flaps that are pivoted into recesses in the cylinder wall in order to make way for the piston to travel through. In this region, there is no effective seal of the piston along the cylinder wall so that there is no guarantee of reliable function. In addition, the pistons can only travel through the cylinder chamber in the inward-pivoting direction of the flaps. Also, the pistons and flaps are subjected to a large amount of wear, so that it is not possible to guarantee long-term function and high torque. The cylinder chamber is encompassed by housing halves attached to each other and that have projections that protrude radially toward the center of the housing and abut a central shaft. Between the projections, a gap is provided through which lever arms are routed, which are attached to the piston at one end and to the central shaft at the other end, with sealing components situated between the projections and the lever arms forming a circular disk. The circular disk-shaped lever arms have recesses for a reduction of pressure.

United Kingdom Reference GB 1 283 907 discloses another rotary piston machine embodied in the form of a metering pump, wherein curved pistons with curved piston rods attached to them are supported in two concentrically opposing semicircular cylinders. The pistons are set into reciprocating motion by a central shaft by a lever, which engages the piston rod, in order to pump a precisely metered quantity of a liquid in a pulsed fashion. In accordance with the curvature of the arc through their cross-sectional area, the ends of the piston rods are each routed so that they pass out of the respective semicircular cylinder and are coupled to the lever outside of the cylinder. As a result of this design, the movement of the piston and shaft is limited to a relatively small angular range, with the design having a primarily synchronizing function. Also, it is difficult to achieve an exact guidance and force transmission between the shaft and piston, particularly at relatively high torques, and the design is unsuitable for transmitting powerful forces and moments.

Piston/cylinder units deflected in a straight line are also widely used for drive purposes, for example to move a lever arm in an excavator. In this instance, the lever arm changes during the pivoting motion, causing a change in the effective moment and the forces involved, particularly also in the bearing positions.

German Patent Reference DE 39 00 375 discloses an internal combustion engine with a piston that smoothly revolves in an annular chamber. The four power cycles of the internal combustion engine in series are integrated into this cylinder chamber. In this instance, it is difficult to achieve a precisely controllable movement sequence over the movement segments. In addition, the design requires complex measures for combustion control, fuel mixture production, and exhaust routing. It is difficult to suitably construct a machine of this kind, particularly with regard to slow movements and high torques. Thus, the current application does not involve an internal combustion engine of this kind.

SUMMARY OF THE INVENTION

One object of this invention is to provide a rotary piston machine with a fluid contained in the cylinder chamber, in particular a noncompressible liquid, with which it is possible to control movement sequences with a high degree of precision, even when transmitting high torques.

This object is attained with characteristics of this invention as described in this specification and in the claims. In this instance, sealing components are inserted into the gap region between the lever and the wall sections that adjoin it on either side in order to prevent an escape of fluid.

This design produces a stable coupling between piston and rotating body. The length of the lever and/or the conduit cross section and effective area of the piston can be used to carry out a broad range of adaptations to the requirements of the respective intended use. Even at high torques, for example in drive unit applications, it is possible to achieve a precise control of movement sequences, such as by a program in a control unit, particularly when a liquid is used as the noncompressible fluid. In a drive unit, the control can be carried out by a precisely operating pump and switching valves that can be triggered in the desired fashion. The cross sections of the piston and conduit chamber do not have to be circular but rather can be embodied in practically any other shape as well. In addition, the lever does not have to be routed through so that it extends out on the side of the conduit wall oriented directly opposite the rotating body, but rather the gap can also be situated, for example, at the top or bottom of the annular conduit, and the annular conduit with its housing can be situated in the movement plane of the lever. With the seal, it is possible to achieve powerful driving forces and precise movement sequences.

An advantageous guidance of the lever and sealing of the gap is achieved if the lever extends, such as in the form of an annulus or a circular disk, over an entire movement range along the length of the gap.

Advantageous measures for achieving the seal include the fact that the wall of the annular conduit is broadened in the radial direction in the region of or near the gap.

For a stable, sealed design the lever and the wall regions of the annular conduit adjoining both sides of the gap can have reciprocally engaging complementary holding structures whose holding forces are oriented in opposition to an opening of the gap.

Additional advantageous measures can include that the holding structure on the annular conduit is in a form of radial projections extending along both sides of the gap and the complementary holding structure on the lever can be in the form of a clip that is claw-shaped in cross section.

The design and function are further benefited by the fact that viewed from above, the lever can be in the form of a circular disk or circular segment or the annular conduit can directly adjoin the outer circumference of the rotating body. Axially mounted shaft stubs on one or both sides can be used for coupling to the rotating body, for example a shaft.

The design and function can also include the fact that the annular conduit is of two shells attached to each other in relation to the movement plane of the piston. The shells can be advantageously screw-mounted to each other at flanges on both sides of the annular conduit and can have various external contours.

Various additional embodiment versions have the rotating body situated or positioned externally or internally with respect to the annular conduit and in particular, can be in the form of a central shaft and the lever can be coupled to the shaft by a hub, which produces a force transmission in both rotation directions or produces a force transmission in only one rotation direction and in the other rotation direction, produces a freewheeling rotation.

Also, at least two pistons that rotate independently of each other can be situated or positioned in a cylinder that encompasses 360° or at least two annular conduits can be coupled to a rotating body and situated on radially opposite sides of the rotating body and/or are axially offset from each other. When several annular conduits are provided, it is possible during parallel operation, for example, to increase the drive moment or vice versa, to increase a pumping capacity. With a radially opposed arrangement of at least two annular conduits, through corresponding control, it is possible to achieve a continuous 360° rotary motion of the rotating body in a drive unit. Through an additional axial offset, it is possible to produce structures with various overlapping of the annular conduits.

A control over a larger angular range can be achieved, for example, by the at least two pistons rotating independently of each other and being situated in a conduit encompassing 360° or by at least two annular conduits being coupled to a rotating body and operated so that the pistons function in a phase-shifted fashion. When two pistons function independently of each other in an annular conduit, one of them is prevented from moving in relation to the conduit by a triggerable locking element.

Another advantageous embodiment for the movement control includes fluid connections of the annular conduits connected to one another so that a restoring of the one piston is produced by the driving of the other piston.

If the dimension of the piston in the arc direction of the circular cylinder is adjustable, then it is possible to carry out exact adjustments.

A design for a reliable function includes the rotary piston machine embodied as a unit for producing reciprocating motion, with it possible to control the connections in an alternating fashion for the influx or outflow of the fluid. The wall of the annular conduit is broader in the gap region and the lever and the wall regions of the annular conduit adjoining both sides of the gap have reciprocally engaging complementary holding structures whose holding forces are oriented in opposition to an opening of the gap. The holding structure on the annular conduit is in a form of radial projections extending along both sides of the gap and the complementary holding structure on the lever is embodied in the form of a clip that is claw-shaped in cross section.

In other advantageous embodiments for a wide variety of possible applications, for example the rotating assembly of a crane, are achieved if the externally situated rotating body is in a form of an external swivel ring and/or the internally situated rotating body is embodied in a form of an internal swivel ring and has a lower and/or upper supporting structure.

Advantageous measures include the swivel ring being supported on a housing part of the annular conduit by ball bearings or rollers.

Measures that contribute to the production of a reliable seal include the sealing components acted on with compressive force from their side oriented away from the surface of the lever.

In another embodiment, two levers with two pistons traveling in the annular conduit and in addition, a locking device with locking mechanisms is provided, which are each able to stop a respective rotating body with the associated piston. The stationary piston forms a conduit bottom for the driving of the respective other piston together with its associated rotating body.

In one advantageous application, the rotary piston machine is used as a steering drive unit of a steered wheel. When there are several steered wheels, an easily adaptable control program can be used to produce individual, mutually adapted controls of the turning angle of the individual wheels of the vehicle.

Another advantageous application includes the rotary piston machine used as a rotary drive unit of a wheel so that in a vehicle, for example, each wheel can be associated with an individual drive unit, with centralized or decentralized control.

BRIEF DESCRIPTION OF THE DRAWINGS

This invention is explained in greater detail in view of exemplary embodiments and with reference to the drawings, wherein.

DETAILED DESCRIPTION OF THE INVENTION

Figure 1:
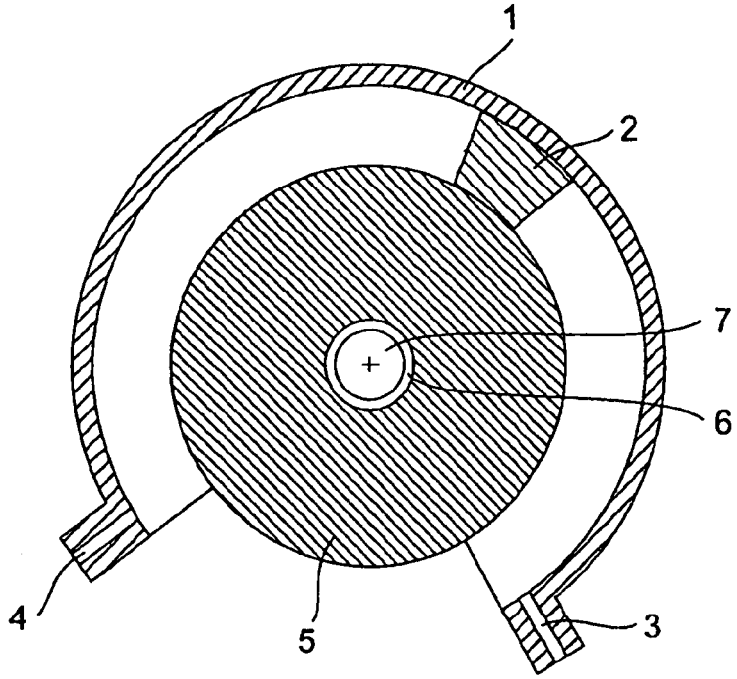
FIG. 1 shows a schematic, sectional top view of a rotary piston machine.

FIG. 1 shows a schematic section taken through a rotary piston machine, perpendicular to a rotating body in the form of a shaft 7. A piston 2 is guided in an annular conduit 1 along a divided circle extending over more than 180°, for example a circular cylinder, and by a lever 5 embodied, for example, in the form of a circular disk, transmits the movement of the piston to the shaft 7 via a hub 6.

The piston 2, functioning for example as a drive element, is moved by a pumping-in of an advantageously noncompressible fluid through a corresponding fluid connection 3 or 4 and a discharging of the fluid via the other fluid connection 4 or 3. To produce the coupling between the lever 5 and the shaft 7, the shaft 7 supports a hub 6 that can be embodied in various ways, for example to transmit the torque to the shaft 7 in one direction and to permit a freewheeling rotation in the other direction or else to transmit torque in both directions. Even with only one annular conduit 1 and a corresponding embodiment of the piston 2, it is possible to cover a relatively large angular range of between 180° and 320°, for example, so that the rotary piston drive unit can be advantageously used as a unit for producing a reciprocating motion, for example for the steering of individual wheels in a vehicle, such as a forklift.

In one embodiment of the rotary piston drive unit, it is possible to provide two or more annular conduits 1 or circular cylinders that are operated in parallel in the same direction or that transmit their torques in opposite directions. The respective other lever can be operated in a freely rotating fashion in relation to the shaft 7. Otherwise, the annular conduits 1 can be arranged on radially opposing sides in relation to the shaft 7, possibly axially offset from each other in relation to the shaft 7 so that by providing a plurality of annular conduits 1, through phase-shifted triggering, it is possible to implement a continuous 360° rotational movement of the shaft. Also, through control without altering the design of the drive unit, with corresponding triggering of switching valves 11, the same drive unit can be used in parallel operation of the annular conduits 1 and at other times can be used in an offset operation. Hybrid forms are also possible. In addition, it is possible for the same machine to cover different torque ranges and angular ranges of motion.

Figure 3:
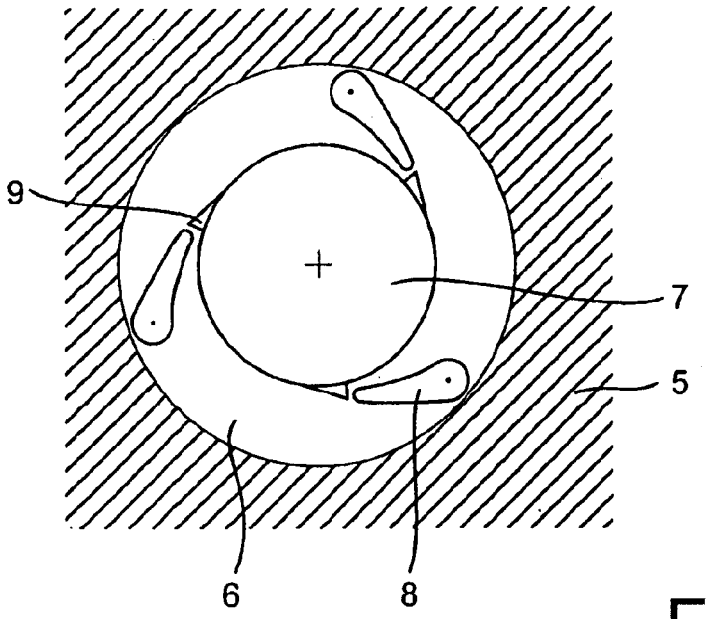
FIG. 3 shows a detail of the rotary piston machine in the region of a coupling of a rotating body in the form of a shaft.

In another embodiment, two pistons operate in the same annular conduit chamber, with the pistons being associated with separate, axially offset levers coupled to the shaft 7 via a hub by releasable locking elements such as ratchets, as schematically depicted in FIG. 3. Thus, the pistons can be moved relative to each other in the cylinder chamber in order to produce the driving action through suitable control.

Figure 2:
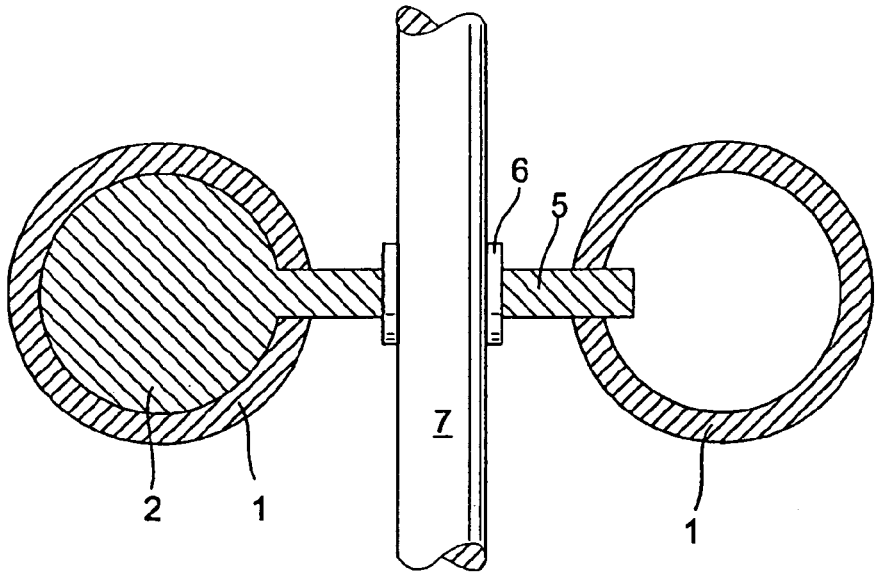
FIG. 2 is a schematic cross-sectional view of the rotary piston machine in relation to the annular conduit.

FIG. 2 is an axial section taken through the rotary piston machine. The piston 2 in the annular conduit 1 or circular cylinder appears on the left side of the drawing. This depiction shows how the lever 5, such as implemented in the form of a circular disk, reaches into the annular conduit 1 and, together with the annular conduit 1, closes the cavity. The lever 5 is affixed to the piston 2.

FIG. 3 shows a cross section taken through the rotary piston machine in the region of or near the shaft 7 and the hub 6. In this instance, a freewheeling action is achieved by locking elements embodied in the form of ratchets 8 and nubs 9 or a set of teeth. The ratchets 8 rest against steep flanks of the nubs 9 in the drive direction whereas in the freewheeling direction, the ratchets 8 slide along past the flat flanks of the nubs 9 or the teeth. A ratchet mechanism of this kind can also comprise double ratchets that can pivot in both directions so that both a driving action and a freewheeling action are enabled in both directions, for which purpose steep and flat tooth flanks in different directions are provided on the shaft or hub, such as axially offset from one another, which cooperate with the ratchets that are then likewise axially offset. A switching magnet or hydraulic actuator, for example, can actuate the ratchets.

Figure 4:
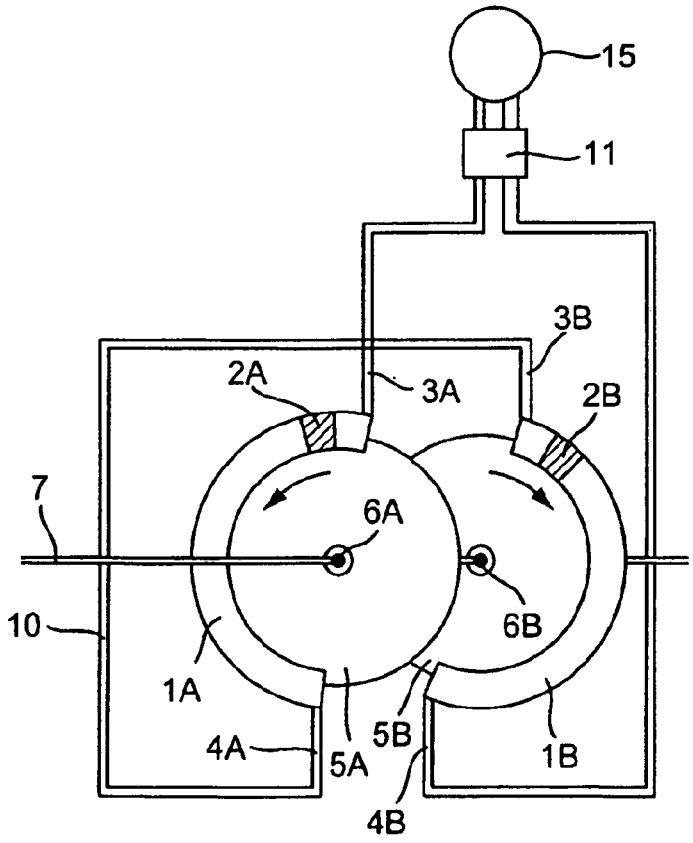
FIG. 4 is a schematic depiction of a coupling of two annular conduits.

FIG. 4 shows a schematic depiction of the coupling of two annular conduits 1 to a rotary piston drive unit. The coupling makes it possible, with a corresponding connection to the switching valve 11, to drive the shaft 7 with a constant torque or to pump the fluid with a constant flow by a pump 15. Thus, the fluid connections 4A and 3B and the fluid connections 3A and 4B are respectively connected via a connecting line 10 so that while the one piston, such as 2A, is driving the shaft 7, the other piston, such as 2B, is being returned. The arrow in FIG. 4 indicates the direction in which a force can be exerted on the shaft 7.

Figure 5:
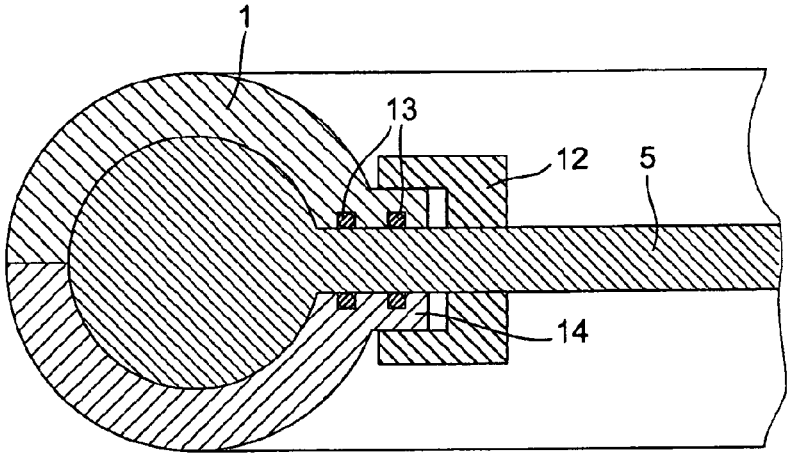
FIG. 5 shows a cross-sectional detail of the rotary piston machine in the region of the coupling between an annular conduit and a lever that extends between the piston and the shaft.

FIG. 5 shows an embodiment of the rotary piston machine in which a pressure on the wall of the annular conduit 1 is absorbed by a claw-shaped clip 12 mounted onto the lever 5. It is thus possible for the wall to be significantly thinner, for example, than it could be without such a clip or for the rotary piston machine to be designed for significantly higher pressure. In the gap region oriented toward the two respective adjacent lever surfaces, sealing components 13, in particular sealing rings, can be advantageously inserted into the projections 14 on both sides in the gap region, which projections are encompassed by the clip 12.

A short lever 5 is achieved, for example, if the shaft 7 and the annular conduit 1 abut each other in the gap region and, for example, a seal is produced in the manner shown in FIG. 5.

In another advantageous provision, the annular conduits 1 are assembled of two parts, such as in the central movement plane of the piston 2, so that the piston 2 and the seals 13 can be used with no trouble. In this instance, it is also possible, for example, for a flange to be formed onto the outside of the annular conduits 1 for the clamping of the two shells of the circular cylinder 1.

The above-describe base unit of the rotary piston machine can be used for various purposes, for example as a centralized or decentralized steering drive unit for wheels, as a rotary drive unit for wheels, as a hydraulic servomotor, or in combination as a hydraulic pump/motor arrangement, such as for replicating a cardan shaft and the like.

Figure 6:
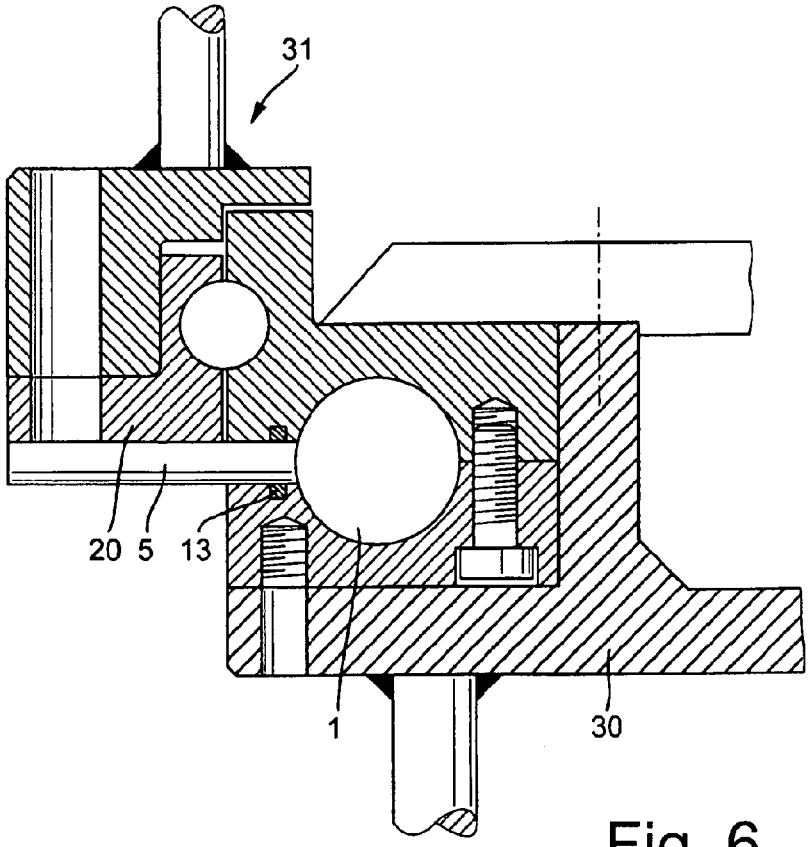
FIG. 6 shows a detail of an exemplary embodiment of the rotary piston machine with an externally situated rotating body.

FIG. 6 shows an embodiment version for the driving of a rotating body, which is situated externally in relation to the annular conduit 1 or circular cylinder. The externally situated rotating body in this instance is supported by a ball bearing on a housing section of the annular conduit 1, in fact on an upper half of the housing, in addition to the lever that is embodied in the form of a circular disk, for example. Correspondingly, the lever 5 in the form of the driving disk is routed so that it passes out through a gap at the outer circumference of the annular conduit 1 and is sealed in the gap by the sealing component 13. The rotating body, in this instance embodied in the form of an external swivel ring 20, is mounted onto the driving disk and in turn has an upper supporting structure 31 on which a structure to be rotated, for example a crane framework, can be mounted. It is also possible to implement a supporting structure 30 on the underside of the external swivel ring 20, if required to meet corresponding requirements. In addition, the housing of the annular conduit 1 can be embodied in a wide variety of ways and can be connected to a base that is suitable to the respective instance. The external swivel ring 20 is supported on the housing of the annular conduit 1 by a four-point bearing component, for example. If needed, the driving disk can alternatively also be routed so that it passes out through a gap situated at the top or bottom, the north or south side, of the annular conduit 1 and can itself continue horizontally or diagonally, for example outward or inward, outside of the gap.

Figure 7:
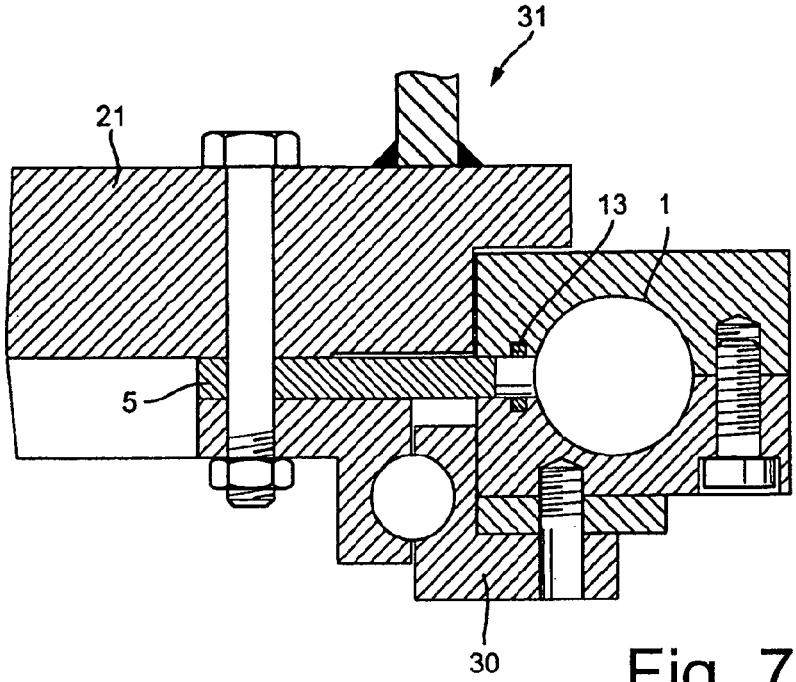
FIG. 7 shows a detail of an exemplary embodiment with an internally situated rotating body.

FIG. 7 shows an embodiment of the rotary piston machine in which the rotating body is embodied in the form of an internal swivel ring 21 to which an upper supporting structure 31 is likewise coupled. In this instance, an additional support by a ball bearing is in the lower region of a section of the annular conduit housing. Here, too, it is alternatively possible to provide a lower supporting structure on the internal swivel ring 21 and a lower supporting structure 30 for accommodating the annular conduit housing. With this embodiment it is also alternatively possible, where suitable, for a gap for the lever 5 to be situated at the top or bottom of the annular conduit 1. In any case, a reliable seal by sealing components 13 is also required.

Figure 8:
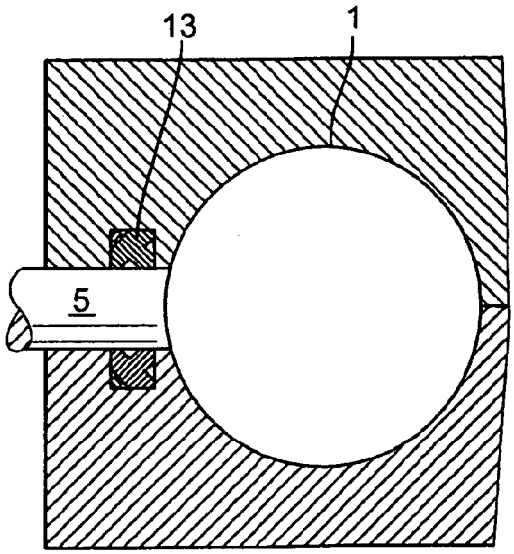
FIG. 8 shows a detail of the rotary piston machine in a sealing region.

FIG. 8 shows a detailed depiction of the sealing components 13. These are inserted into an annular groove in the gap region on the housing component and are embodied so that they produce a reliable seal in relation to the lever 5 around the annular conduit 1, in both the axial and radial direction. Thus, the outside of the sealing component 13 oriented away from the surface of the lever 5 is by a compressive force, for example effected by a fluid, which can be the same fluid as in the annular conduit 1 that is supplied via separate conduits. The hydraulic pressure can be suitably adjusted and safeguarded, for example, by valves. Also in the chamber of the annular conduit, transitions, where present, between housing components as well as between the housing and piston and/or lever 5 can be sealed by additional sealing components that are simultaneously embodied with adapted guide surfaces where necessary. The contact pressure in this instance can be provided in the manner described above.

Figure 9A:
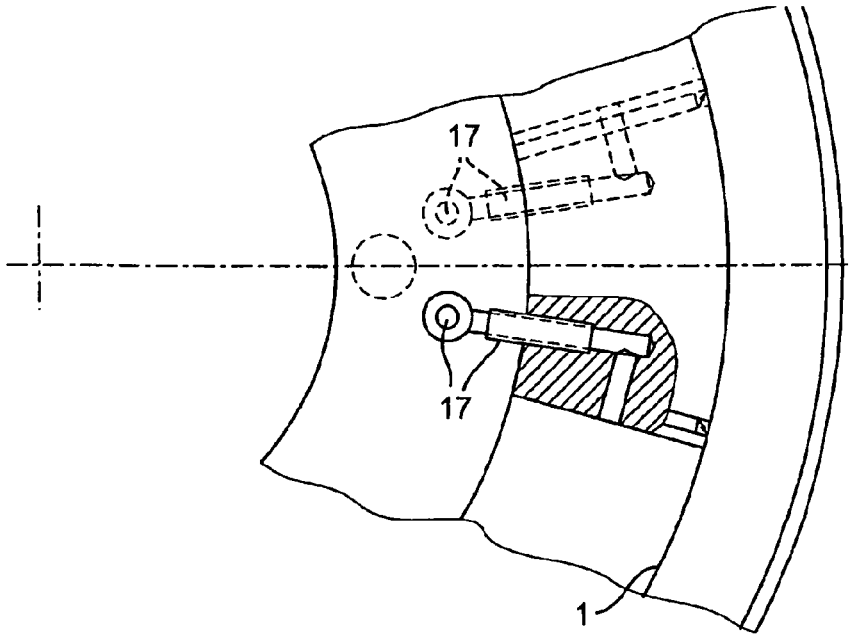
FIGS. 9A and 9B each shows a detail of another exemplary embodiment of the rotary piston machine, with two levers and a shared annular conduit.
Figure 9B:
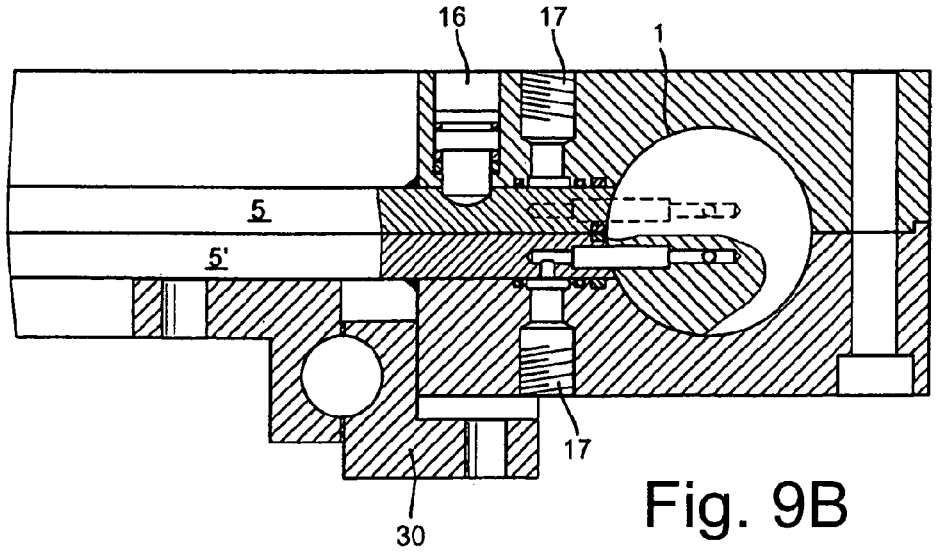

Another embodiment of the rotary piston machine is shown in FIG. 9A, a partially cut-away detail viewed from above, and 9B, a partially cut-away detail viewed in cross section. In this embodiment, two separate levers 5 preferably embodied as driving disks are connected to two pistons 2 that are driven in the same annular conduit 1. A driving disk 5 is stopped by a hydraulic or electromechanical locking system equipped with locking mechanisms 16 and forms a bottom in the annular conduit against which a pressure can build up in order to drive the freely rotating driving disk 5' with the other piston 2. With this, the mobile driving disk 5' can be driven to execute a rotation of approximately 315°, for example, which causes a hydraulic or an electromechanical switching of the locking mechanism 16. The previously driven driving disk 5' with its piston 2 is stopped by the associated locking mechanism 16 and the previously stationary driving disk 5 is unlocked and released. This alternating switching of the rotary pistons 2 with their driving disks 5, 5' is able to produce any rotation angle. For the control, an oil supply line 17 and a return are formed by the housing, the driving disks 5, 5', and the pistons 2, as shown in FIGS. 9A and 9B. In connection with the rotating bodies described above, this design can be used in various ways in a variety of applications and structures.

The invention claimed is:

1. A rotary piston machine comprising at least one annular conduit (1) curved along an at least partial arc and in which a piston (2) is movably supported in a movement-imparting fluid that flows in via a fluid connection (3 or 4) and flows out via another fluid connection (4 or 3), the piston being coupled via a lever (5) to a rotating body arranged concentric to the arc and coaxial to a rotation axis of the piston, with the lever (5) routed to pass through to the rotating body through a sealed gap in a wall of the annular conduit (1) and extending in a movement direction of the piston (2), wherein sealing components (13) are inserted into a gap region between the lever (5) and wall sections adjoining on both sides, to prevent an escape of the fluid, wherein the lever (5) and the wall sections of the annular conduit (1) adjoining both sides of the gap have reciprocally engaging complementary holding structures with holding forces oriented in opposition to an opening of the gap.

2. The rotary piston machine as recited in claim 1, wherein the lever (5) extends along an entire length of the gap.

3. The rotary piston machine as recited in claim 2, wherein the wall of the annular conduit (1) is broadened on an outside in the gap region.

4. The rotary piston machine as recited in claim 1, wherein a holding structure on the annular conduit (1) is formed as radial projections (14) extending along both sides of the gap and a complementary holding structure on the lever (5) is formed as a clip (12) having a claw-shaped cross section.

5. The rotary piston machine as recited in claim 4, wherein as viewed from above the lever (5) is formed as a circular disk or a circular segment or the annular conduit (1) directly adjoins an outer circumference of the rotating body (7).

6. The rotary piston machine as recited in claim 5, wherein the annular conduit (1) has two shells attached to each other in relation to a movement plane of the piston (2).

7. The rotary piston machine as recited in claim 6, wherein the rotating body is situated externally or internally with respect to the annular conduit (1), is formed as a central shaft (7), and the lever (5) is coupled to the shaft (7) by a hub (6) which produces a force transmission in both rotation directions or produces a force transmission in only one rotation direction and in the other rotation direction produces a free-wheeling rotation.

8. The rotary piston machine as recited in claim 7, wherein at least two annular conduits (1) are coupled to the rotating body and at least one of are situated on radially opposite sides of the rotating body or are axially offset from each other.

9. The rotary piston machine as recited in claim 8, wherein at least two annular conduits (1) are coupled to the rotating body and operated so that the pistons function in a phase-shifted fashion.

10. The rotary piston machine as recited in claim 9, wherein fluid connections (4.1, 4.2) of the annular conduits (1) are connected to one another so that a restoring of the one piston (2) is produced by a driving of the other piston (2).

11. The rotary piston machine as recited in claim 10, wherein a dimension of the piston in an arc direction of the annular conduit (1) is adjustable.

12. The rotary piston machine as recited in claim 11, wherein the rotary piston machine is embodied as a unit for producing reciprocating motion to control connections in an alternating fashion for an influx or an outflow of the fluid, the wall of the annular conduit (1) is thicker in the gap region.

13. The rotary piston machine as recited in claim 12, wherein at least one of the externally situated rotating body is formed as an external swivel ring (20) or the internally situated rotating body is formed as an internal swivel ring (21) and has at least one of a lower or upper supporting structure (30, 31).

14. The rotary piston machine as recited in claim 13, wherein the rotating body is supported on a housing part of the annular conduit (1) by ball bearings or rollers.

15. The rotary piston machine as recited in claim 14, wherein the sealing components (13) are acted on with compressive force from a side oriented away from the surface of the lever.

16. The rotary piston machine as recited in claim 15, wherein two levers (5) with two pistons (2) traveling in the annular conduit (1) and a locking device with locking mechanisms (16) each is adapted to stop a respective rotating body with an associated piston (2) and a stationary piston (2) forms a conduit bottom for the driving of the respective other piston (2) together with its associated rotating body.

17. The rotary piston machine as recited in claim 16, wherein the rotary piston machine is used as a steering drive unit of a wheel.

18. The rotary piston machine as recited in claim 11, wherein the rotary piston machine is used as a rotary drive unit of a wheel.

19. The rotary piston machine as recited in claim 8, wherein at least one of the externally situated rotating body is formed as an external swivel ring (20) or the internally situated rotating body is formed as an internal swivel ring (21) and has at least one of a lower or upper supporting structure (30, 31).

20. The rotary piston machine as recited in claim 7, wherein the rotating body is supported on a housing part of the annular conduit (1) by ball bearings or rollers.

21. The rotary piston machine as recited in claim 1, wherein the wall of the annular conduit (1) is broadened on an outside in the gap region.

22. The rotary piston machine as recited in claim 1, wherein as viewed from above the lever (5) is formed as a circular disk or a circular segment or the annular conduit (1) directly adjoins an outer circumference of the rotating body (7).

23. The rotary piston machine as recited in claim 1, wherein the annular conduit (1) has two shells attached to each other in relation to a movement plane of the piston (2).

24. The rotary piston machine as recited in claim 1, wherein the rotating body is situated externally or internally with respect to the annular conduit (1), is formed as a central shaft (7), and the lever (5) is coupled to the shaft (7) by a hub (6) which produces a force transmission in both rotation directions or produces a force transmission in only one rotation direction and in the other rotation direction produces a freewheeling rotation.

25. The rotary piston machine as recited in claim 1, wherein at least two annular conduits (1) are coupled to the rotating body and at least one of are situated on radially opposite sides of the rotating body or are axially offset from each other.

26. The rotary piston machine as recited in claim 25, wherein at least two annular conduits (1) are coupled to the rotating body and operated so that the pistons function in a phase-shifted fashion.

27. The rotary piston machine as recited in claim 1, wherein the rotary piston machine is used as a steering drive unit of a wheel.

28. The rotary piston machine as recited in claim 1, wherein the rotary piston machine is used as a rotary drive unit of a wheel.

29. A rotary piston machine comprising at least one annular conduit (1) curved along an at least partial arc and in which a piston (2) is movably supported in a movement-imparting fluid that flows in via a fluid connection (3 or 4) and flows out via another fluid connection (4 or 3), the piston being coupled via a lever (5) to a rotating body arranged concentric to the arc and coaxial to a rotation axis of the piston, with the lever (5) routed to pass through to the rotating body through a sealed gap in a wall of the annular conduit (1) and extending in a movement direction of the piston (2), wherein sealing components (13) are inserted into a gap region between the lever (5) and wall sections adjoining on both sides, to prevent an escape of the fluid, wherein at least two annular conduits (1) are coupled to the rotating body and at least one of are situated on radially opposite sides of the rotating body or are axially offset from each other, at least two annular conduits (1) are coupled to the rotating body and operated so that the pistons function in a phase-shifted fashion, and fluid connections (4.1, 4.2) of the annular conduits (1) are connected to one another so that a restoring of the one piston (2) is produced by a driving of the other piston (2).

30. A rotary piston machine comprising at least one annular conduit (1) curved along an at least partial arc and in which a piston (2) is movably supported in a movement-imparting fluid that flows in via a fluid connection (3 or 4) and flows out via another fluid connection (4 or 3), the piston being coupled via a lever (5) to a rotating body arranged concentric to the arc and coaxial to a rotation axis of the piston, with the lever (5) routed to pass through to the rotating body through a sealed gap in a wall of the annular conduit (1) and extending in a movement direction of the piston (2), wherein sealing components (13) are inserted into a gap region between the lever (5) and wall sections adjoining on both sides, to prevent an escape of the fluid, wherein a dimension of the piston in an arc direction of the annular conduit (1) is adjustable.

31. The rotary piston machine as recited in claim 30, wherein the lever (5) and the wall sections of the annular conduit (1) adjoining both sides of the gap have reciprocally engaging complementary holding structures with holding forces oriented in opposition to an opening of the gap.

32. A rotary piston machine comprising at least one annular conduit (1) curved along an at least partial arc and in which a piston (2) is movably supported in a movement-imparting fluid that flows in via a fluid connection (3 or 4) and flows out via another fluid connection (4 or 3), the piston being coupled via a lever (5) to a rotating body arranged concentric to the arc and coaxial to a rotation axis of the piston, with the lever (5) routed to pass through to the rotating body through a sealed gap in a wall of the annular conduit (1) and extending in a movement direction of the piston (2), wherein sealing components (13) are inserted into a gap region between the lever (5) and wall sections adjoining on both sides, to prevent an escape of the fluid, wherein the rotary piston machine is embodied as a unit for producing reciprocating motion to control connections in an alternating fashion for an influx or an outflow of the fluid, the wall of the annular conduit (1) is thicker in the gap region, the lever (5) and the wall regions of the annular conduit (1) adjoining both sides of the gap have reciprocally engaging complementary holding structures whose holding forces are oriented in opposition to an opening of the gap, and the holding structure on the annular conduit (1) is formed as radial projections (14) extending along both sides of the gap and the complementary holding structure on the lever (5) is formed as a clip (12) having a claw-shaped cross section.

33. The rotary piston machine as recited in claim 32, wherein the lever (5) and the wall sections of the annular conduit (1) adjoining both sides of the gap have reciprocally engaging complementary holding structures with holding forces oriented in opposition to an opening of the gap.

34. The rotary piston machine as recited in claim 33, wherein a holding structure on the annular conduit (1) is formed as radial projections (14) extending along both sides of the gap and a complementary holding structure on the lever (5) is formed as a clip (12) having a claw-shaped cross section.

35. A rotary piston machine comprising at least one annular conduit (1) curved along an at least partial arc and in which a piston (2) is movably supported in a movement-imparting fluid that flows in via a fluid connection (3 or 4) and flows out via another fluid connection (4 or 3), the piston being coupled via a lever (5) to a rotating body arranged concentric to the arc and coaxial to a rotation axis of the piston, with the lever (5) routed to pass through to the rotating body through a sealed gap in a wall of the annular conduit (1) and extending in a movement direction of the piston (2), wherein sealing components (13) are inserted into a gap region between the lever (5) and wall sections adjoining on both sides, to prevent an escape of the fluid, wherein the sealing components (13) are acted on with compressive force from a side oriented away from the surface of the lever.

36. A rotary piston machine comprising at least one annular conduit (1) curved along an at least partial arc and in which a piston (2) is movably supported in a movement-imparting fluid that flows in via a fluid connection (3 or 4) and flows out via another fluid connection (4 or 3), the piston being coupled via a lever (5) to a rotating body arranged concentric to the arc and coaxial to a rotation axis of the piston, with the lever (5) routed to pass through to the rotating body through a sealed gap in a wall of the annular conduit (1) and extending in a movement direction of the piston (2), wherein sealing components (13) are inserted into a gap region between the lever (5) and wall sections adjoining on both sides, to prevent an escape of the fluid, wherein two levers (5) with two pistons (2) traveling in the annular conduit (1) and a locking device with locking mechanisms (16) each is adapted to stop a respective rotating body with an associated piston (2) and a stationary piston (2) forms a conduit bottom for the driving of the respective other piston (2) together with its associated rotating body.

* * * * *